United States Patent [19]

Nishida

[11] Patent Number: 4,688,509

[45] Date of Patent: Aug. 25, 1987

[54] SMALL-SIZED MARINE CRAFT WITH DECK CONSTRUCTION PROVIDING GRIPS

[75] Inventor: Hiroshi Nishida, Miki, Japan

[73] Assignee: Kawasaki Jukogyo Kabushiki Kaisha, Kobe, Japan

[21] Appl. No.: 765,512

[22] Filed: Aug. 14, 1985

[30] Foreign Application Priority Data

Aug. 16, 1984 [JP] Japan ..... 59-124837[U]

[51] Int. Cl.[4] ..... B63H 11/02

[52] U.S. Cl. ..... 114/363; 114/56; 114/270; 297/195

[58] Field of Search ..... 297/195; 180/219, 140; 114/270, 363, 56; 441/65; 440/38

[56] References Cited

U.S. PATENT DOCUMENTS 3,294,055 12/1966 McGuire ..... 114/270
3,827,392 8/1974 Jones ..... 440/38
4,171,731 10/1979 Hilber ..... 180/219
4,357,893 11/1982 Frye ..... 114/270
4,413,700 11/1983 Shiratsuchi ..... 180/219

*Primary Examiner*—Joseph F. Peters, Jr.
*Assistant Examiner*—Edwin L. Swinehart
*Attorney, Agent, or Firm*—Leydig, Voit & Mayer

[57] ABSTRACT

A small sized marine craft comprising a shell including a deck having a central upwardly projecting protrusion on the rear of the deck and a seat assembly covering an upper portion of the protrusion and extending laterally at both sides to provide overhanging or downwardly and outwardly facing grips for a rider to hold onto. When covered by a seat assembly, both lower ends of the seat assembly are extended laterally away from the surfaces of the protrusion such as to form the grips for the rider.

4 Claims, 4 Drawing Figures

SMALL-SIZED MARINE CRAFT WITH DECK CONSTRUCTION PROVIDING GRIPS

BACKGROUND OF THE INVENTION

1. Field of the Invention

The present invention relates to a small-sized marine craft for use in marine sports or for leisure purposes, which is suited to running about the sea area near the shore under the control of a rider on a deck portion who grips a steering handle bar positioned at the bow portion of the shell from a location on the stern portion. More particularly, the invention is concerned with a construction of the deck of a small-sized marine craft of the type mentioned above to provide grips for a rider to hold himself on the craft.

2. Description of the Related Art

In general, a small-sized marine craft of the kind described has an engine mounted in an engine room formed in the bow portion of the shell and a propulsion means provided at the stern portion of the same. The rider stands up or sits on a deck portion formed on the shell to the rear of the engine room and grips the steering handle bar on the bow portion of the shell.

The shell has a breadth which is substantially equal to or slightly greater than the shoulder breadth of a rider.

The propulsion means may be a propeller or a pumped water jet. Where a pumped water jet is used, the marine craft can be steered by changing the direction of the jet.

This type of marine craft is generally light in weight and has an excellent running performance. For instance, it can run at a high speed of 50 km/h or so and, therefore, the rider or a fellow rider, if any, sometimes accidentally fall into the water. In the known marine craft, however, the riders, particularly the fellow rider, can find no suitable support to hold on except the steering handle bar, because the marine craft is usually designed to have no projection on the deck to meet the demand for attractive appearance.

SUMMARY OF THE INVENTION

Accordingly, an object of the invention is to provide a small-sized marine craft having a deck construction which is improved to offer a stable support for a fellow rider to hold himself on the craft, thereby overcoming the above-described problems of the prior art.

To this end, according to the invention, there is provided a small-sized marine craft comprising: a shell including a deck having a central upwardly projecting protrusion, and means on the upper portion of the protrusion extending laterally at both sides to provide grips for a rider to hold onto when sitting on the protrusion; an engine mounted on a bow portion of the hull; a propulsion means on a stern portion of the hull; and a steering handle means on the bow portion of the hull.

The above and other objects, features and advantages of the invention will become clear from the following description of the preferred embodiments when the same is read in conjunction with the accompanying drawings.

DESCRIPTION OF THE PREFERRED EMBODIMENTS

Figure 1:
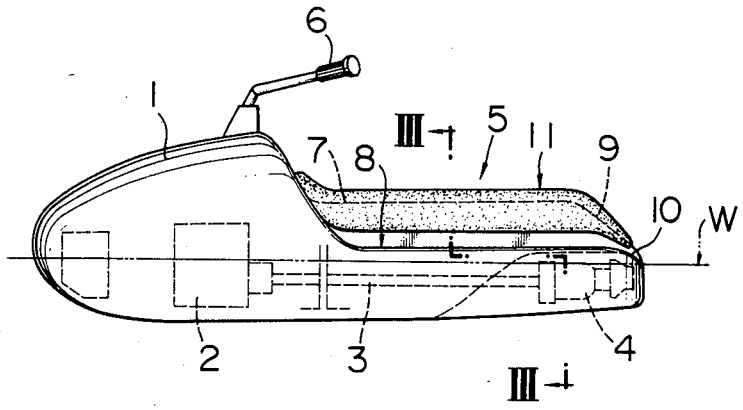
FIG. 1 is a side elevational view of an embodiment of a small-sized marine craft in accordance with the invention.
Figure 2:
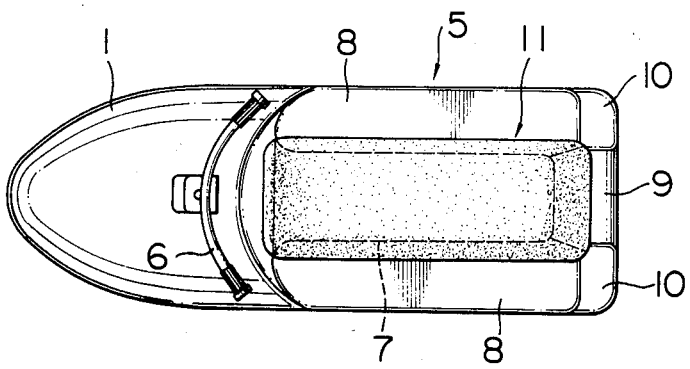
FIG. 2 is a plan view of the small-sized marine craft shown in FIG. 1.

Referring to FIGS. 1 to 2, a small-sized marine craft in accordance with the invention has a shell in the bow portion of which is formed hermetically an engine room 1. The engine room 1 accommodates an engine 2 which drives, through a drive shaft 3, a propeller 4 on the stern bottom portion of the hull. A rear deck 5 provides seats for a rider and one or more fellow riders. The rider grips a handle bar 6 on the bow portion so as to steer the marine craft while supporting himself.

Figure 3:
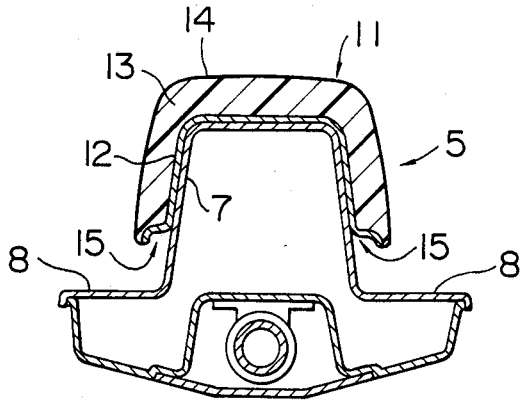
FIG. 3 is a cross-sectional view taken along the line III—III of FIG. 1.

As shown in FIGS. 1 to 3, the rear of the deck 5 has a central upwardly projecting protrusion as at 7 such as to form step portions 8 on both sides of the protrusion 7. The rear end of the protrusion 7 slopes rearwardly and downwardly. In the illustrated embodiment, the step portions 8 also slope rearwardly and downwardly. The rearwardly and downwardly sloping ends 9, 10, 10 facilitate the rider in the water to climb onto the deck. In FIG. 1, the water line is indicated by two-dot-and-dash line W.

A seat assembly 11 is mounted on the protrusion 7 such as to cover the protrusion 7. As will be seen from FIG. 3, the seat assembly is composed of a seat bottom plate 12, seat cushion 13 and a seat cover 14 and is usually hinged at its front or rear portion such as to be swung thereby making a space under the seat accessible.

As will be clearly seen from FIG. 3, the lower ends of the bottom plate 12 of seat assembly 11 on both sides are flaring horizontally laterally away from both side surfaces of the protrusion 7, at a level considerably above the level of the step portions 8. The lateral extensions 15 form and overhanging downwardly facing grips for a rider. Namely, a rider or a fellow rider seated on the seat assemly with his feet resting on the step portions 8 can hold onto the grips on the lateral extensions 15 of the seat assembly such as to stably support himself even during sharp steering of the marine craft.

In the illustrated embodiment, the lateral extensions 15 are provided over the entire length of the seat assembly 11 or the protrusion 7, so that the rider can freely select the sitting position along the length of the seat assembly 11.

In the embodiment shown in FIGS. 1 to 3, the grip portions for a fellow rider are provided on the lateral extensions 15 on the lower ends of both sides of the seat assembly 11. This arrangement provides quite a simple means for the fellow rider to stably support himself, without requiring any projection on the deck presenting an obstacle.

Although in this embodiment only the seat 11 is laterally extended as at 15 to provide the grips for the fellow rider while both side surfaces of the protrusion 7 remain flat, this is illustrative and not exclusive and the arrangement may be such that the protrusion 7, which is integral with the deck, itself is extended laterally to provide the grips, as in the case of another embodiment which will be explained hereinunder with reference to FIG. 4.

Figure 4:
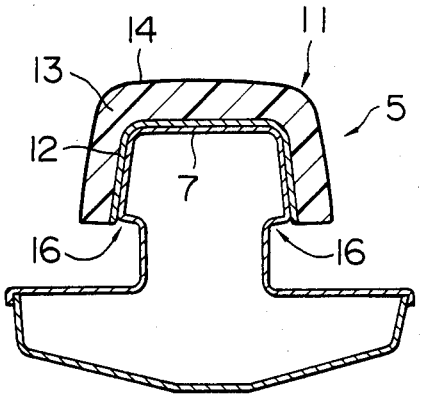
FIG. 4 is an illustration of an essential portion of another embodiment.

Namely, in the embodiment shown in FIG. 4, an upper portion of the protrusion 7 is extended laterally at each side of the protrusion 7 such as to form overhanging sections 16 on which are formed the grips for the fellow rider. Other aspects of this embodiment are substantially identical to those of the first embodiment explained in connection with FIGS. 1 to 3 and are denoted by the same reference numerals, with detailed description thereof being omitted.

It will be clear to those skilled in the art that the second embodiment offers the same advantages as those presented by the first embodiment.

Although the invention has been described through specific terms, it is to be noted here that the described embodiments are not exclusive and various changes and modifications may be imparted thereto without departing from the scope of the invention which is limited solely by the appended claims.

What is claimed is:

1. A small-sized marine craft comprising:

a shell including a deck having a central upwardly projecting longitudinally extending protrusion having an upper surface located above the rear of the deck;

means including a seat assembly mounted on the upper surface of said protrusion and extending below the upper surface and laterally on both sides of said protrusion to form overhanging downwardly facing grips for a rider to hold onto;

an engine mounted on a bow portion of said shell;

a propulsion means on a stern portion of said shell; and a steering handle means on the bow portion of said shell.

2. A small-sized marine craft according to claim 1 wherein said protrusion is an inverted U-shaped hollow upwardly projecting protrusion, said seat assembly includes a U-shaped bottom plate conforming to the protrusion and located thereon, and a U-shaped cushion on said bottom plate and providing a seat, said U-shaped bottom plate having ends flaring away from the protrusion to form said grips.

3. A small-sized marine craft comprising:

a shell including a deck having a central upwardly projecting longitudinally extending protrusion at the rear of the deck;

means including a seat assembly mounted on an upper portion of said protrusion and extending laterally away from side surfaces of said protrusion to form overhanging grips for a rider to hold onto;

an engine mounted on a bow portion of said shell;

a propulsion means on a stern portion of said shell; and a steering handle means on the bow portion of said shell.

4. A small-sized marine craft according to claim 3 wherein said grips are formed over the entire length of said longitudinally extending protrusion.

* * * * *